US008599088B2

(12) United States Patent
Chiang et al.

(10) Patent No.: US 8,599,088 B2
(45) Date of Patent: Dec. 3, 2013

(54) DUAL-BAND ANTENNA WITH ANGLED SLOT FOR PORTABLE ELECTRONIC DEVICES

(75) Inventors: Bing Chiang, Cupertino, CA (US); Gregory Allen Springer, Sunnyvale, CA (US); Douglas B. Kough, San Jose, CA (US); Enrique Ayala, Watsonville, CA (US); Matthew Ian McDonald, San Jose, CA (US); Hao Xu, Cupertino, CA (US)

(73) Assignee: Apple Inc., Cupertino, CA (US)

( * ) Notice: Subject to any disclaimer, the term of this patent is extended or adjusted under 35 U.S.C. 154(b) by 1080 days.

(21) Appl. No.: 11/959,191

(22) Filed: Dec. 18, 2007

(65) Prior Publication Data

US 2009/0153411 A1 Jun. 18, 2009

(51) Int. Cl.
*H01Q 13/10* (2006.01)

(52) U.S. Cl.
USPC ..... 343/770

(58) Field of Classification Search
USPC ..... 343/767, 770
See application file for complete search history.

(56) References Cited

U.S. PATENT DOCUMENTS

| | | | |
|---|---|---|---|
| 6,369,771 | B1 | 4/2002 | Chiang et al. |
| 6,670,923 | B1 | 12/2003 | Kadambi et al. |
| 6,741,214 | B1 | 5/2004 | Kadambi et al. |
| 6,747,601 | B2 | 6/2004 | Boyle |
| 6,774,852 | B2 | 8/2004 | Chiang et al. |
| 6,788,266 | B2 * | 9/2004 | St. Hillaire et al. ..... 343/770 |
| 6,856,294 | B2 | 2/2005 | Kadambi et al. |
| 6,888,510 | B2 | 5/2005 | Jo et al. |
| 6,980,154 | B2 | 12/2005 | Vance et al. |
| 7,027,838 | B2 | 4/2006 | Zhou et al. |
| 7,116,267 | B2 | 10/2006 | Lee |
| 7,119,747 | B2 | 10/2006 | Lin et al. |

(Continued)

FOREIGN PATENT DOCUMENTS

| | | |
|---|---|---|
| CN | 1700514 | 11/2005 |
| CN | 1930731 | 3/2007 |

(Continued)

OTHER PUBLICATIONS

Jacob, N. et al. "Investigationof Wide-Band Microstrip Slot Antenna." IEEE Transactions on Antennas and Propagation. vol. 52, No. 3, p. 865-872, Mar. 2004.

(Continued)

*Primary Examiner* — Robert Karacsony
(74) *Attorney, Agent, or Firm* — Treyz Law Group; G. Victor Treyz; Michael H. Lyons

(57) ABSTRACT

Dual slot antennas are provided for portable electronic devices such as handheld electronic devices. A dual slot antenna may have an open slot that has an open end that is not encircled by conductive material and may have a closed slot in which each end is surrounded by conductor. The closed and open slots may have portions that run parallel to each other. The antenna may be fed using feed terminals that bridge the closed and open slots in the vicinity of the portions of the slots that run parallel to each other. The slots may have portions that are angled with respect to each other. An end portion of one of the slots may be bent and widened for impedance matching and broadened bandwidth. Other portions of the slots may also be angled with respect to their main longitudinal axes.

5 Claims, 7 Drawing Sheets

(56) References Cited

U.S. PATENT DOCUMENTS

| | | | | |
|---|---|---|---|---|
| 7,123,208 | B2 | 10/2006 | Baliarda et al. | |
| 7,239,290 | B2 | 7/2007 | Poilasne et al. | |
| 2003/0090426 | A1* | 5/2003 | Sun et al. | 343/770 |
| 2003/0107518 | A1 | 6/2003 | Li et al. | |
| 2004/0051670 | A1* | 3/2004 | Sato | 343/702 |
| 2004/0056812 | A1* | 3/2004 | Sabet et al. | 343/725 |
| 2004/0145521 | A1 | 7/2004 | Hebron et al. | |
| 2005/0200545 | A1* | 9/2005 | Bancroft | 343/770 |
| 2006/0055606 | A1 | 3/2006 | Boyle | |

FOREIGN PATENT DOCUMENTS

| | | |
|---|---|---|
| CN | 2935501 | 8/2007 |
| CN | 200969391 | 10/2007 |
| DE | 198 17 573 | 10/1999 |
| JP | 2004 266573 | 9/2004 |

OTHER PUBLICATIONS

Hill et al. U.S. Appl. No. 11/650,187, filed Jan. 4, 2007.
Hill et al. U.S. Appl. No. 11/821,192, filed Jun. 21, 2007.
Hill et al. U.S. Appl. No. 11/897,033, filed Aug. 28, 2007.
Zhang et al. U.S. Appl. No. 11/895,053, filed Aug. 22, 2007.
Chiang et al. U.S. Appl. No. 11/702,039, filed 2/1/07.
R. Bancroft "A Commercial Perspective on the Development and Integration of an 802.11a/b/g HiperLan/WLAN Antenna into Laptop Computers", IEEE Antennas and Propagation Magazine, vol. 48, No. 4, Aug. 2006, pp. 12-18.
B. Chiang et al. "Invasion of Inductor and Capacitor Chips in the Design of Antennas and Platform Integration", IEEE International Conference on Portable Information Devices, May 2007, pp. 1-4.
A. Lai et al. "Infinite Wavelength Resonant Antennas With Monopolar Radiation Pattern Based on Periodic Structures", IEEE Transactions on Antennas and Propagation, vol. 55, No. 3, Mar. 2007, pp. 868-876.

* cited by examiner

DUAL-BAND ANTENNA WITH ANGLED SLOT FOR PORTABLE ELECTRONIC DEVICES

BACKGROUND

This invention relates to antennas, and more particularly, to antennas for portable electronic devices.

Due in part to their mobile nature, portable electronic devices are often provided with wireless communications capabilities. Portable electronic devices may use wireless communications to communicate with wireless base stations. For example, cellular telephones may communicate using cellular telephone bands at 850 MHz, 900 MHz, 1800 MHz, and 1900 MHz (e.g., the main Global System for Mobile Communications or GSM cellular telephone bands). Portable electronic devices may also use other types of communications links. For example, portable electronic devices may communicate using the Wi-Fi® (IEEE 802.11) bands at 2.4 GHz and 5.4 GHz and the Bluetooth® band at 2.4 GHz. Communications are also possible in data service bands such as the 3 G data communications band at 2100 MHz band (commonly referred to as UMTS or Universal Mobile Telecommunications System).

To satisfy consumer demand for small form factor wireless devices, manufacturers are continually striving to reduce the size of components that are used in these devices. For example, manufacturers have made attempts to miniaturize the antennas used in portable electronic devices.

A typical antenna may be fabricated by patterning a metal layer on a circuit board substrate or may be formed from a sheet of thin metal using a foil stamping process. These techniques can be used to produce antennas that fit within the tight confines of a compact portable device such as a handheld electronic device. With conventional portable electronic devices, however, design compromises are made to accommodate compact antennas. These design compromises may include, for example, compromises related to antenna efficiency and antenna bandwidth.

It would therefore be desirable to be able to provide improved antennas for portable electronic devices.

SUMMARY

Multiband slot antennas are provided for portable electronic devices such as handheld electronic devices. The multiband slot antennas may have a ground plane element with first and second openings that define respective first and second dielectric-filled slots. The first slot may be an open slot that has an air-filled end. The second slot may be a closed slot having ends that are surrounded by portions of the ground plane.

The open and closed slots may each have a main longitudinal axes. The main longitudinal axis of the closed slot may be angled with respect to the main longitudinal axis of the open slot. The slots may have additional angled portions and may have straight portions that run parallel to each other. The antenna may be fed using antenna terminals that bridge the first and second slots in the vicinity of the straight portions.

An end portion of one of the slots may be angled and widened with respect to the remainder of that slot for impedance matching and to enhance the bandwidth associated with that slot.

The first and second slots may be formed in part of a conductive portable electronic device housing. A dielectric support structure with conductive vias may be used to route signals from antenna feed terminals across the first and second slots.

Further features of the invention, its nature and various advantages will be more apparent from the accompanying drawings and the following detailed description of the preferred embodiments.

DETAILED DESCRIPTION

The present invention relates generally to electronic devices, and more particularly, to antennas for wireless electronic devices.

The wireless electronic devices may be portable electronic devices such as laptop computers, tablet computers, wireless access point base stations such as IEEE 802.11 base stations, plug-in relay stations such as those for IEEE 802.11 communications, or small portable computers of the type that are sometimes referred to as ultraportables. Portable electronic devices may also be somewhat smaller devices. Examples of smaller portable electronic devices include wrist-watch devices, pendant devices, headphone and earpiece devices, and other wearable and miniature devices. With one suitable arrangement, which is sometimes described herein as an example, the portable electronic devices may be handheld electronic devices.

Examples of portable and handheld electronic devices include cellular telephones, media players with wireless communications capabilities, handheld computers (also sometimes called personal digital assistants), remote controls, global positioning system (GPS) devices, and handheld gaming devices. The devices may also be hybrid devices that combine the functionality of multiple conventional devices. Examples of hybrid devices include a cellular telephone that includes media player functionality, a gaming device that includes a wireless communications capability, a cellular telephone that includes game and email functions, and a handheld device that receives email, supports mobile telephone calls, has music player functionality and supports web browsing. These are merely illustrative examples.

Figure 1:
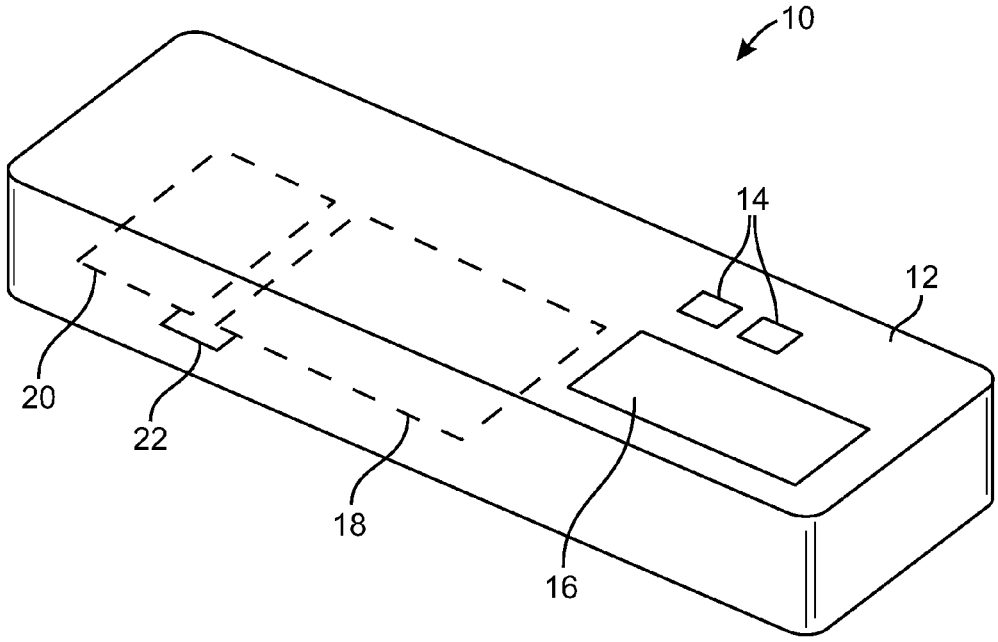
FIG. 1 is a perspective view of an illustrative portable electronic device such as a handheld electronic device in accordance with an embodiment of the present invention.

An illustrative portable electronic device such as a handheld electronic device in accordance with an embodiment of the present invention is shown in FIG. 1. Device 10 may be any suitable portable or handheld electronic device.

Device 10 may handle communications over one or more communications bands. For example, wireless communications circuitry in device 10 may be used to handle cellular telephone communications in one or more frequency bands and data communications in one or more communications bands. Typical data communications bands that may be handled by the wireless communications circuitry in device 10 include the 2.4 GHz band that is sometimes used for Wi-Fi® (IEEE 802.11) and Bluetooth® communications, the 5.4 GHz band that is sometimes used for Wi-Fi communications, the 1575 MHz Global Positioning System band, and 3 G data bands (e.g., the UMTS band at 1920-2170). These bands may be covered by using single and multiband antennas. For example, cellular telephone communications can be handled using a multiband cellular telephone antenna and local area network data communications can be handled using a multiband wireless local area network antenna. As another example, a device 10 may have a single multiband antenna for handling communications in two or more data bands (e.g., at 2.4 GHz and at 5.4 GHz). If desired, the antenna structures in device 10 may be used to implement multiple-in-multiple out (MIMO) schemes such as those used in supporting the IEEE 802.11n standard and in high-capacity cellular telephones, etc.

Device 10 may have housing 12. Housing 12, which is sometimes referred to as a case, may be formed of any suitable materials including plastic, glass, ceramics, metal, other suitable materials, or a combination of these materials. In some situations, housing 12 or portions of housing 12 may be formed from a dielectric or other low-conductivity material, so that operation of conductive antenna elements that are located in proximity to housing 12 is not disrupted by the housing. Housing 12 or portions of housing 12 may also be formed from conductive materials such as metal. An illustrative metal housing material that may be used is anodized aluminum. Aluminum is relatively light in weight and, when anodized, has an attractive insulating and scratch-resistant surface. If desired, other metals can be used for the housing of device 10, such as stainless steel, magnesium, titanium, alloys of these metals and other metals, etc. In scenarios in which housing 12 is formed from metal elements, one or more of the metal elements may be used as part of the antenna in device 10. For example, metal portions of housing 12 and metal components in housing 12 may be shorted together to form a ground plane in device 10 or to expand a ground plane structure that is formed from a planar circuit structure as a printed circuit board structure (e.g., a printed circuit board structure used in forming antenna structures for device 10).

Device 10 may have one or more buttons such as buttons 14. Buttons 14 may be formed on any suitable surface of device 10. In the example of FIG. 1, buttons 14 have been formed on the top surface of device 10.

If desired, device 10 may have a display such as display 16. Display 16 may be a liquid crystal diode (LCD) display, an organic light emitting diode (OLED) display, a plasma display, or any other suitable display. The outermost surface of display 16 may be formed from one or more plastic or glass layers. If desired, touch screen functionality may be integrated into display 16 or may be provided using a separate touch pad device. An advantage of integrating a touch screen into display 16 to make display 16 touch sensitive is that this type of arrangement can save space and reduce visual clutter. Buttons 14 may, if desired, be arranged adjacent to display 16. With this type of arrangement, the buttons may be aligned with on-screen options that are presented on display 16. A user may press a desired button to select a corresponding one of the displayed options.

Device 10 may have circuitry 18. Circuitry 18 may include storage, processing circuitry, and input-output components. Wireless transceiver circuitry in circuitry 18 may be used to transmit and receive radio-frequency (RF) signals. Transmission lines such as coaxial transmission lines and microstrip transmission lines may be used to convey radio-frequency signals between transceiver circuitry and antenna structures in device 10. As shown in FIG. 1, for example, transmission line 22 may be used to convey signals between antenna structure 20 and circuitry 18. Transmission line 22 may be, for example, a coaxial cable that is connected between an RF transceiver (sometimes called a radio) and a multiband antenna.

Figure 2:
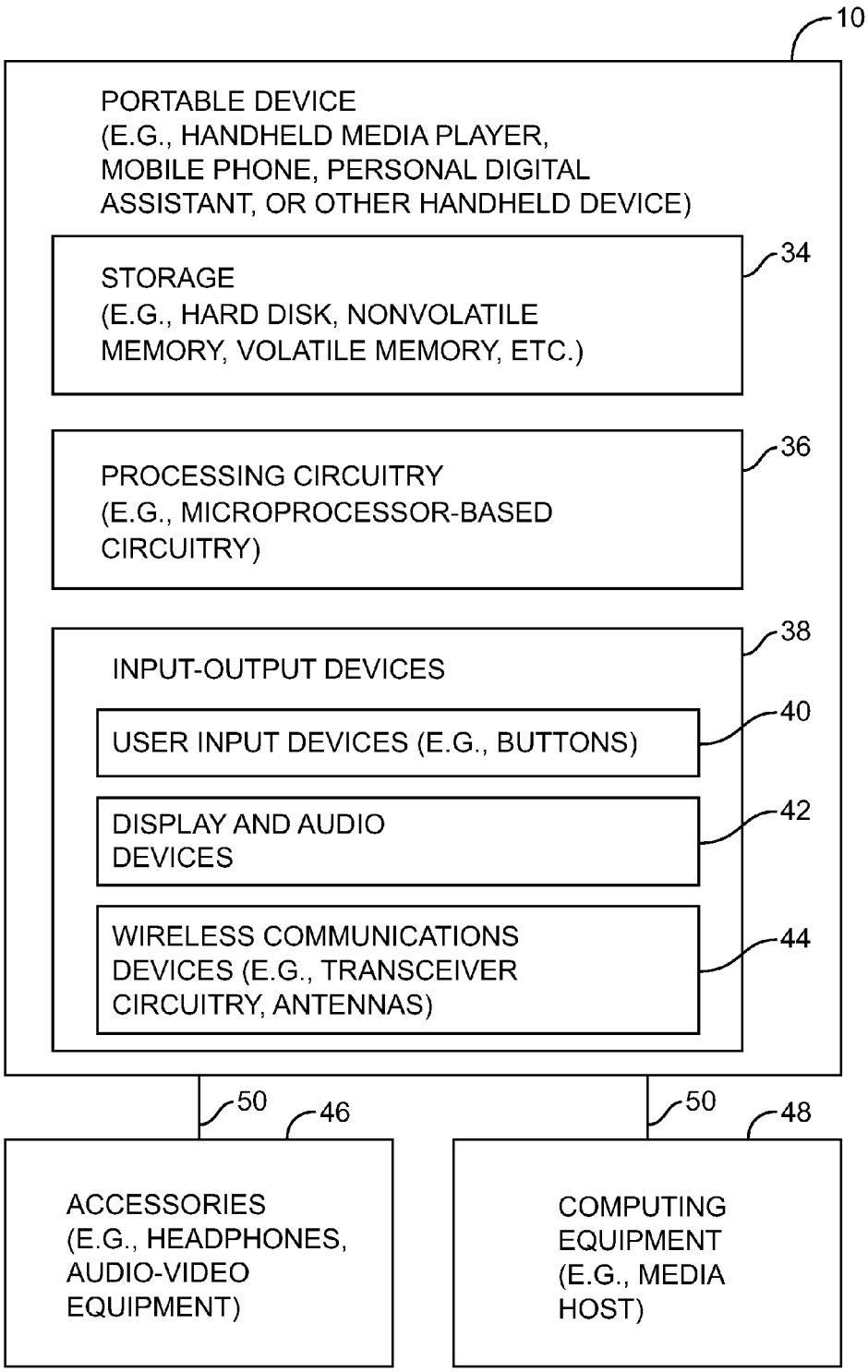
FIG. 2 is a schematic diagram of an illustrative portable electronic device in accordance with an embodiment of the present invention.

A schematic diagram of an embodiment of an illustrative portable electronic device is shown in FIG. 2. Portable device 10 may be a mobile telephone, a mobile telephone with media player capabilities, a handheld computer, a remote control, a game player, a global positioning system (GPS) device, a combination of such devices, or any other suitable portable or handheld electronic device.

As shown in FIG. 2, portable device 10 may include storage 34. Storage 34 may include one or more different types of storage such as hard disk drive storage, nonvolatile memory (e.g., flash memory or other electrically-programmable-read-only memory), volatile memory (e.g., battery-based static or dynamic random-access-memory), etc.

Processing circuitry 36 may be used to control the operation of device 10. Processing circuitry 36 may be based on a processor such as a microprocessor and other suitable integrated circuits. With one suitable arrangement, processing circuitry 36 and storage 34 are used to run software on device 10, such as internet browsing applications, voice-over-internet-protocol (VOIP) telephone call applications, email applications, media playback applications, operating system functions, etc. Processing circuitry 36 and storage 34 may be used in implementing suitable communications protocols. Communications protocols that may be implemented using processing circuitry 36 and storage 34 include internet protocols, wireless local area network protocols (e.g., IEEE 802.11 protocols—sometimes referred to as Wi-Fi®), protocols for other short-range wireless communications links such as the Bluetooth® protocol, protocols for handling 3 G data services such as UMTS, cellular telephone communications protocols, etc.

Input-output devices 38 may be used to allow data to be supplied to device 10 and to allow data to be provided from device 10 to external devices. Display screen 16 and buttons 14 of FIG. 1 are examples of input-output devices 38.

Input-output devices 38 may include user input-output devices 40 such as buttons, touch screens, joysticks, click wheels, scrolling wheels, touch pads, key pads, keyboards, microphones, cameras, speakers, tone generators, vibrating elements, etc. A user can control the operation of device 10 by supplying commands through user input devices 40.

Display and audio devices 42 may include liquid-crystal display (LCD) screens or other screens, light-emitting diodes (LEDs), and other components that present visual information and status data. Display and audio devices 42 may also include audio equipment such as speakers and other devices for creating sound. Display and audio devices 42 may contain audio-video interface equipment such as jacks and other connectors for external headphones and monitors.

Wireless communications devices 44 may include communications circuitry such as radio-frequency (RF) transceiver circuitry formed from one or more integrated circuits, power amplifier circuitry, passive RF components, one or more antennas (e.g., antenna structures such as antenna structures 20 of FIG. 1), and other circuitry for handling RF wireless signals. Wireless signals can also be sent using light (e.g., using infrared communications).

Device 10 can communicate with external devices such as accessories 46 and computing equipment 48, as shown by paths 50. Paths 50 may include wired and wireless paths. Accessories 46 may include headphones (e.g., a wireless cellular headset or audio headphones) and audio-video equipment (e.g., wireless speakers, a game controller, or other equipment that receives and plays audio and video content).

Computing equipment 48 may be any suitable computer. With one suitable arrangement, computing equipment 48 is a computer that has an associated wireless access point or an internal or external wireless card that establishes a wireless connection with device 10. The computer may be a server (e.g., an internet server), a local area network computer with or without internet access, a user's own personal computer, a peer device (e.g., another handheld electronic device 10), or any other suitable computing equipment.

The antenna structures and wireless communications devices of device 10 may support communications over any suitable wireless communications bands. For example, wireless communications devices 44 may be used to cover communications frequency bands such as the cellular telephone bands at 850 MHz, 900 MHz, 1800 MHz, and 1900 MHz, data service bands such as the 3 G data communications band at 2100 MHz band (commonly referred to as UMTS or Universal Mobile Telecommunications System), Wi-Fi® (IEEE 802.11) bands (also sometimes referred to as wireless local area network or WLAN bands), the Bluetooth® band at 2.4 GHz, and the global positioning system (GPS) band at 1575 MHz. Wi-Fi bands that may be supported include the 2.4 GHz band and the 5.0 GHz bands. The 5.0 GHz Wi-Fi bands extend from 5.15-5.85 GHz and are sometimes referred to by their approximate center frequency of 5.4 GHz (i.e., these communications frequencies are sometimes referred to as making up a 5.4 GHz communications band). Device 10 can cover these communications bands and/or other suitable communications bands with proper configuration of the antenna structures in wireless communications circuitry 44.

Figure 3:
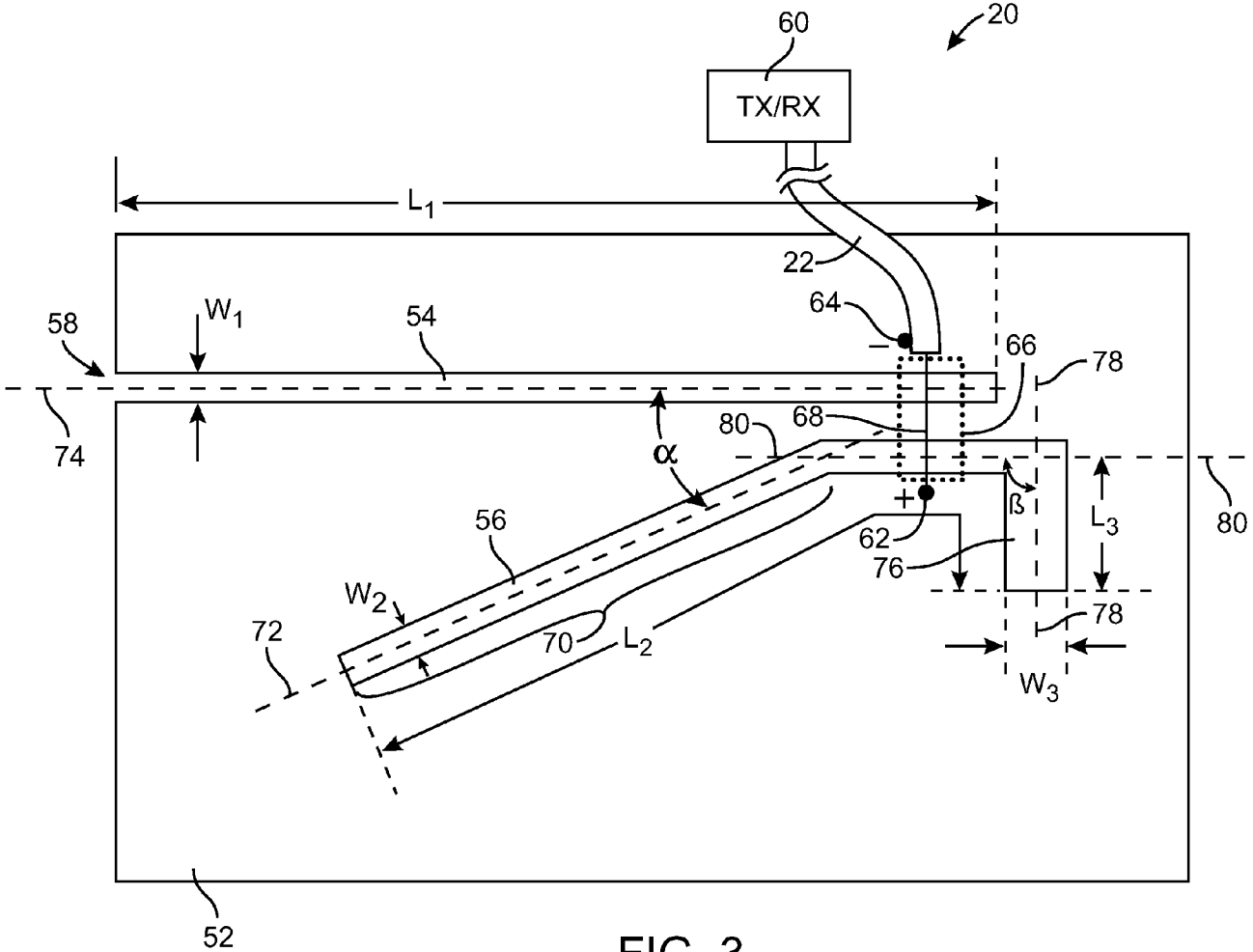
FIG. 3 is a diagram of an illustrative dual slot antenna in which one of the slots has an angled portion in accordance with an embodiment of the present invention.

A top view of illustrative antenna structures in accordance with an embodiment of the present invention is shown in FIG. 3. As shown in FIG. 3, antenna 20 may be formed from a ground plane structure such as ground plane 52. Ground plane 52 may be formed from a printed circuit board, a planar metal structure, conductive electrical components, conductive housing walls, other suitable conductive structures, or combinations of these structures. With one suitable arrangement, ground plane 52 may be formed from one or more conductive layers on a printed circuit board. The printed circuit board may be rigid or flexible. An example of a rigid circuit board substrate is fiberglass-filled epoxy (e.g., FR4). An example of a flexible printed circuit board material is polyimide. Flexible printed circuits are sometimes referred to as flex circuits and may be mounted to dielectric support structures such as plastic supports.

Antenna resonating elements for antenna 20 may be formed from openings in ground plane 52. In the example of FIG. 3, there are two openings in ground plane 52: opening 54 and opening 56. These openings are typically filled with air, but may, if desired, be filled with other suitable dielectrics such as plastic. Because openings such as openings 54 and 56 have lengths that are typically longer than their widths, openings of this type are often referred to as slots.

Slots 54 and 56 serve as antenna resonating elements for antenna 20, whereas ground plane 52 serves as a ground plane element for antenna 20. The slots and ground plane are sometimes referred to as forming "poles" for antenna 20. For example, a first antenna structure may be formed by slot 54 (which serves as a first of two antenna poles for the first antenna structure) and ground plane 52 (which serves as a second of two antenna poles for the first antenna structure). Similarly, a second antenna structure can be formed from slot 56 (which serves as a first of two antenna poles for the second antenna structure) and ground plane 52 (which serves as a second of two antenna poles for the second antenna structure). Slots 54 and 56 may resonate at different frequencies, so that the antenna that is formed from slots 54 and 56 (and from ground plane 52) serves as a multiband antenna. The antenna structure formed from slot 54 and ground plane 52 may handle a first communications band, whereas the antenna structure formed from slot 56 and ground plane 52 may handle a second communications band.

Slots 54 and 56 may have any suitable shapes. For example, slot 54 may be completely surrounded by portions of ground plane element 52 (as with slot 56) or may have openings (as with opening 58 of slot 54). In a typical configuration, slots 54 and 56 are relatively long and thin. With this type of configuration, slots 54 and 56 have longitudinal dimensions that significantly exceed their lateral dimensions.

Any suitable feed arrangement may be used to feed antenna 20. As shown schematically in the example of FIG. 3, a transmission line such as coaxial transmission line may be used to convey radio-frequency signals between antenna 20 and a radio-frequency transceiver such as radio-frequency transceiver 60. Transceiver circuitry 60 may include one or more transceivers for handling communications in one or more discrete communications bands. For example, transceiver circuitry 60 may be used to handle communications in 2.4 GHz and 5.4 GHz communications bands.

Transmission line 22 may be coupled to antenna 20 at feed terminals such as feed terminals 62 and 64. Feed terminal 64 may be referred to as a ground or negative feed terminal and may be shorted to the outer (ground) conductor of transmission line 22. Feed terminal 62 may be referred to as the positive antenna terminal. Transmission line center conductor 68 may be used to connect transmission line 22 to positive feed terminal 62. If desired, other types of antenna coupling arrangements may be used (e.g., based on near-field coupling, using impedance matching networks, etc.).

As shown schematically by dotted line 66 in FIG. 3, the feed arrangement for antenna 3 may include a matching network. Matching network 66 may include a balun (to match an unbalanced transmission line to a balanced antenna or to match a balanced transmission line to an unbalanced antenna) and/or an impedance transformer (to help match the impedance of the transmission line to the impedance of the antenna).

In the example of FIG. 3, slot 54 has a length L1 and a width W1, whereas slot 56 has a length L2 and a width W2. Slot widths W1 and W2 may be, for example, about 0.1 to 0.5 mm. The use of relatively small slot widths W1 and W2 may help reduce the length of the center conductor 68 (or comparable conductive structures used in matching network 66). If feed structures such as center conductor 68 are too large, their lengths may approach a quarter of a wavelength at the radio frequencies being handled by transceiver 60. This could cause center conductor 68 to resonate, thereby reducing efficiency. Because relatively small slot widths W1 and W2 may allow use of a reduced feed width (i.e., a smaller lateral spacing between positive antenna feed terminal 62 and ground terminal 64), the use of small slot widths W1 and W2 may enhance antenna efficiency.

The length associated with open slot such as slot 54 may be substantially equal to a quarter of a wavelength at the slot's frequency of operation. For example, the length L1 of open-ended slot 54 may be substantially equal to a quarter of a wavelength in a first communications band (i.e., at 2.4 GHz). The length of a close-ended slot such as closed slot 56 may be substantially equal to half of a wavelength at the slot's frequency of operation. For example, the length L2 of close-ended slot 56 may be substantially equal to half of a wavelength in a second communications band (i.e., at 5.4 GHz). With this illustrative configuration, the lengths L1 and L2 may be, for example, about 10-20 mm (e.g., about 16 mm).

An advantage of arrangements of the type shown in FIG. 3 in which an open-ended slot such as slot 54 is used to cover a lower frequency band while a close-ended slot such as slot 56 is used to cover a higher frequency band is that this prevents the slot that is associated with the lower frequency band from being much longer than the slot that is associated with the upper frequency band and allows the size of antenna 20 to be minimized. For example, the use of an open-ended geometry for slot 54 in the FIG. 3 arrangement allows the length of slot 54 to be roughly equal to the length of slot 56, even though slot 54 is used to cover a frequency band at roughly half of the frequency of the frequency band associated with slot 56.

Slot 54 and/or slot 56 may contain portions that are not straight. In the illustrative arrangement of FIG. 3, for example, slot 56 has angled portion 70. Angled portion 70 has a longitudinal axis (i.e., main longitudinal axis 72 of slot 56) that is oriented at an angle $\alpha$ with respect to main longitudinal axis 74 of slot 54. Angle $\alpha$ may have a value of 10-45°, a value of 5-85°, or a value of 15-40° (as examples). The use of a non-zero angle $\alpha$ between slots 54 and 56 in antenna 20 helps to reduce near-field electromagnetic coupling between slots 54 and 56. Such near-field coupling can create antenna losses, so the use of a non-zero angle to separate slots 54 and 56 can help to improve antenna efficiency.

As shown in FIG. 3, a slot in antenna 20 such as slot 56 may have a portion such as portion 76 that is angled (bent). Bent portion 76 may have an associated axis (longitudinal axis 78) that is oriented at a non-zero angle $\beta$ with respect to axis 80. Axis 80 is aligned with a central portion of slot 56 (i.e., a portion of slot 56 that lies between angled portion 70 and angled portion 76) and is aligned with main longitudinal axis 74 of slot 54. In the example of FIG. 3, axis 78 and axis 80 are oriented at right angles with respect to each other (i.e., angle $\beta$ is 90° in FIG. 3). If desired, end portion 76 can be angled at other angles (e.g., angles $\beta$ of between 70° and 110°). The use of a 90° angle in the FIG. 3 arrangement is merely illustrative.

Because end portion 76 is angled, the footprint associated with slot 56 may be reduced in size. This may help ensure that slots 54 and 56 and ground plane element 52 can be accommodated within the potentially tight confines of housing 12. Angled end portion 76 may also help to match the impedance of slot 56 to the impedance of the antenna feed (e.g., transmission line 22).

Portion 76 of slot 56 may have an associated length L3 along longitudinal axis 78 and may have a width W3. The length L3 of portion 76 is typically significantly smaller than overall slot length L2. With one illustrative arrangement, the width W3 is greater than width W2. For example, in configurations in which width W2 is about 0.1 to 0.5 mm, width W3 may be 0.6 mm to several mm (as an example).

Figure 4:
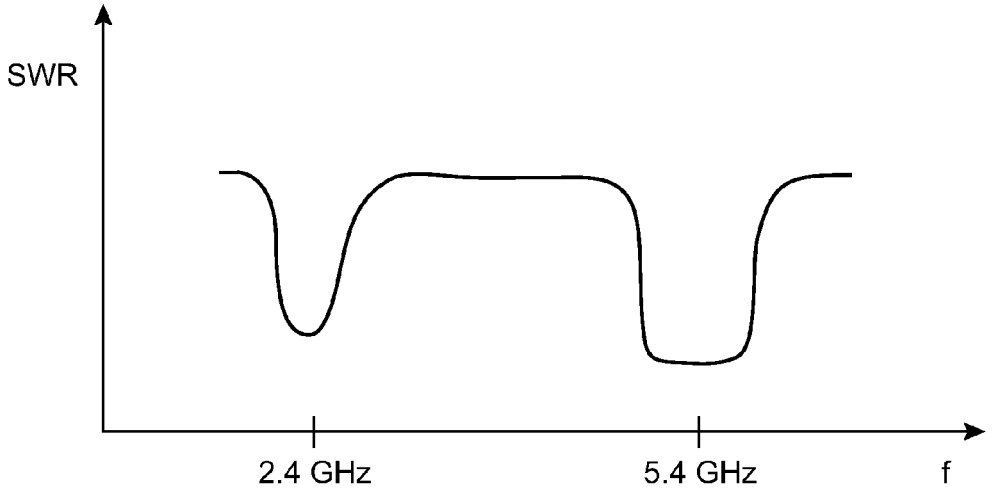
FIG. 4 is a graph showing the performance of an illustrative dual slot antenna in which an end portion of the slot that handles the higher-frequency band is widened to enhance the bandwidth of the higher-frequency band in accordance with an embodiment of the present invention.

The larger width of angled portion 76 relative to the other portions of slot 56 may help to increase the bandwidth of slot 56. This is illustrated in FIG. 4. FIG. 4 is a graph in which the standing wave ratio (SWR) for an antenna such as antenna 20 of FIG. 3 has been plotted as a function of frequency. As shown in FIG. 4, antenna 20 of FIG. 3 covers a lower frequency band at 2.4 GHz and a higher frequency band at 5.4 GHz. Because of the presence of widened end portion 76 in slot 56, the antenna bandwidth in the 5.4 GHz band (which is associated with slot 56) is larger than the antenna bandwidth in the 2.4 GHz band (which is associated with slot 54). This type of behavior may be helpful when the higher frequency band (e.g., the 5.4 GHz band in the FIG. 4 example) requires a relatively larger bandwidth than the lower frequency band.

Slots 54 and 56 may be configured so that the second harmonic of the lower-frequency slot (slot 54) coincides with the higher-frequency band (directly or at a slight frequency offset). In this type of situation, the frequency response of the fundamental harmonic of slot 56 (e.g., at 5.4 GHz) may be widened due to both the presence of end portion 76 and the frequency response contribution of the second harmonic of lower-frequency slot 54. If desired, the low frequency slot in antenna 20 (e.g., antenna slot 54) may be provided with a widened end portion in addition to or as an alternative to providing slot 56 with widened end portion 76.

As shown in FIG. 3, widened end portion 76 may have a substantially rectangular shape. If desired, other shapes may be used for end portion 76 (e.g., portions with curved sides or other non-rectangular shapes). The use of a rectangular widened end portion 76 in the arrangement of FIG. 3 is merely illustrative.

Figure 5:
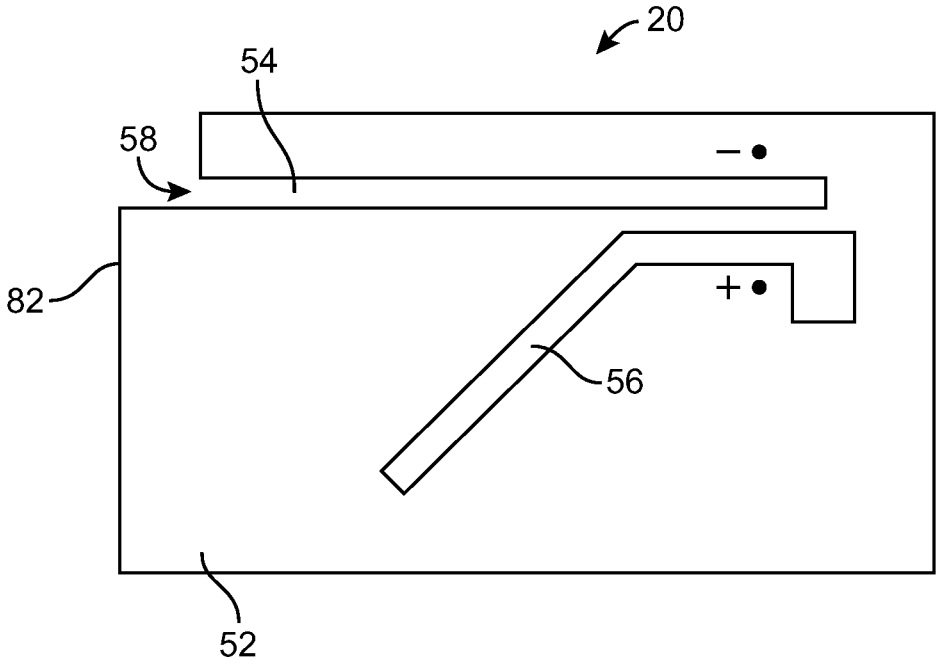
FIG. 5 is a diagram of an illustrative dual slot antenna with an alternative open slot configuration in accordance with an embodiment of the present invention.

FIG. 5 shows an alternative layout that may be used for slot 54. As shown in the arrangement of FIG. 5, slot 54 in antenna 20 may have an opening 58 that is not completely aligned with edge 82 of ground plane 52. Nevertheless, arrangements of the type shown in FIG. 5 may provide satisfactory antenna performance. In certain device configurations, omitting a corner of ground plane 52 as shown in FIG. 5 may help ground plane 52 fit within housing 12 of device 10.

Figure 6:
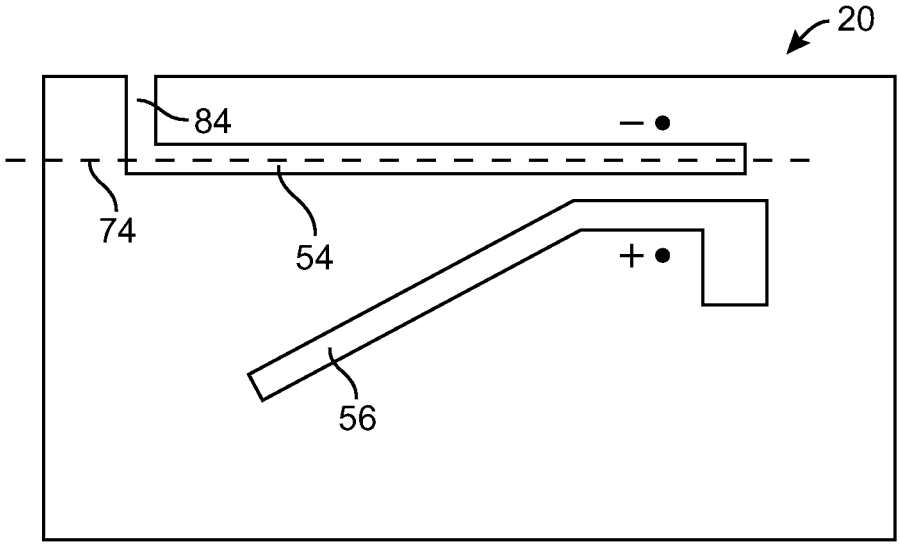
FIG. 6 is a diagram of an illustrative dual slot antenna with an angled slot and a substantially straight slot having a relatively short angled portion in accordance with an embodiment of the present invention.

Another possibly slot geometry is shown in FIG. 6. In the FIG. 6 example, slot 54 has angled end portion 84. Angled end portion 84 may be angled at any suitable angle with respect to longitudinal axis 74. For example, angled end portion 84 may be oriented so that its longitudinal axis lies perpendicular to axis 74 as shown in FIG. 6. The width of slot portion 84 may be the same as the width of the other portions of slot 54 or may be different (e.g., wider or narrower). As with arrangements of the type shown in FIG. 5, the use of bent slot portion 84 in slot 54 may help antenna 20 accommodate design constraints such as constraints imposed by the geometry of device housing 12.

Figure 7:
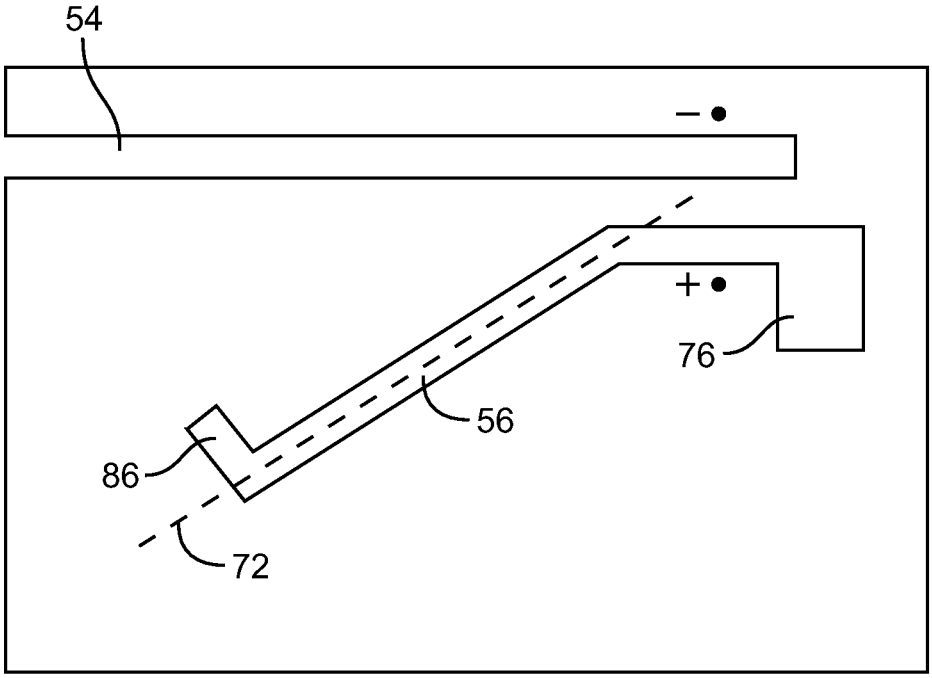
FIG. 7 is a diagram of an illustrative dual slot antenna having an angled slot with a relatively short angled portion at one of its ends in accordance with an embodiment of the present invention.

FIG. 7 shows how slot 56 may have an angled portion such as angled portion 86. Angled portion 86 and widened end portion 76 may be formed at opposite ends of slot 56. Angled end portion 86 may be oriented at any suitable angle with respect to the other portions of slot 56. For example, angled end portion 86 may be oriented so that its longitudinal axis is perpendicular to main longitudinal axis 72 of slot 56 as shown in FIG. 7. Portion 86 may have the same width as the central portion of slot 56 or may be wider or narrower than the central portion of slot 56. The use of an angled portion such as angled portion 86 may help antenna 20 accommodate layout constraints (as an example).

Slot features such as uneven slot end 58 of slot 54 in FIG. 5, angled portion 84 of open slot 54 of FIG. 6, angled and widened slot portion 76 of slot 56 of FIG. 3, angled slot portion 70 of slot 56 of FIG. 3, and angled end portion 86 of closed slot 56 of FIG. 7 may be used in any desired combination. The geometries of slots 54 and 56 that are shown in FIGS. 3, 5, 6, and 7 are merely illustrative.

Figure 8:
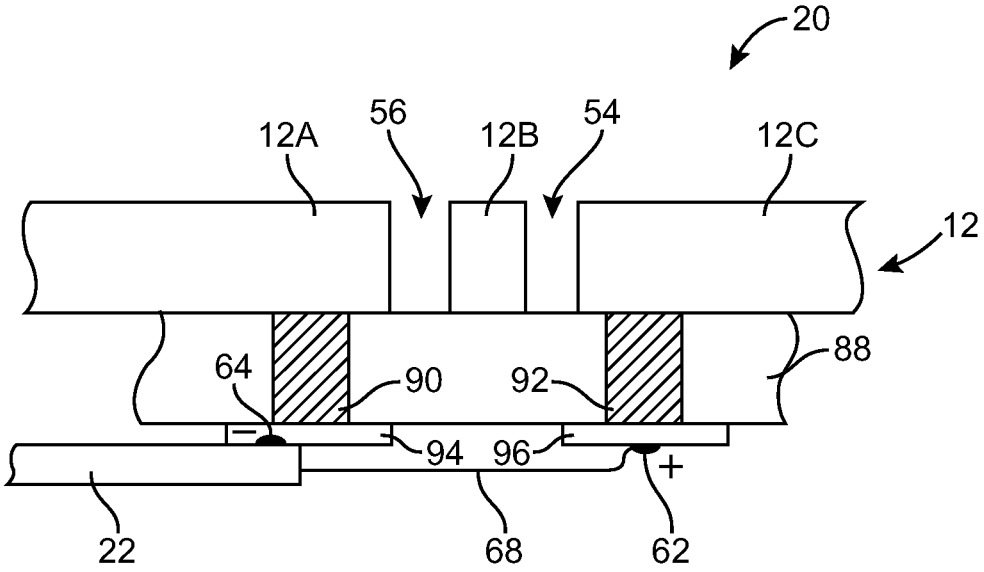
FIG. 8 is a cross-sectional side view of an illustrative dual slot antenna formed in a portable electronic device housing in accordance with an embodiment of the present invention.

If desired, antenna 20 may be integrated into a wall of housing 12 or may be otherwise mounted to an exterior portion of device 10. This type of arrangement is shown in the cross-sectional view of FIG. 8. As shown in FIG. 8, housing 12 may have housing wall portions 12A, 12B, and 12C that define slots such as slots 56 and 54. Slots 54 and 56 may be filled with air or other suitable dielectric. Dielectric antenna feed structure 88 may be mounted to the interior of housing 12 in device 10. Structure 88 may be formed from a layer of flex circuit or other suitable dielectric materials. Vias such as vias 90 and 92 may be used to provide conductive pathways through dielectric structure 88. Vias 90 and 92 may be formed from metal or other suitable conductors. An example of a metal that may be used to form vias 90 and 92 is nickel.

Conductive pads such as pads 94 and 96 may be formed on the interior surface of dielectric support structure 88. Pads 94 and 96 may be formed of metal or any other suitable conductive material. Similar pads may be formed on the opposing surface of dielectric support 88 to facilitate electrical contact between vias 90 and 92 and conductive housing wall portions 12A and 12C.

Pads 94 and 96 may serve as ground and positive antenna feed terminals for antenna 20. In the schematic representation of FIG. 8, antenna terminals 62 and 64 are shown as being fed using a coaxial cable 22. The coaxial cable may have an outer ground conductor that is electrically connected to ground antenna terminal 64 and may have a center conductor such as center conductor 68 that is electrically connected to positive antenna terminal 62. This is, however, merely illustrative. Any suitable transmission line and/or matching network structures may be used to feed antenna terminals 62 and 64. The arrangement of FIG. 8 is presented as an example.

The foregoing is merely illustrative of the principles of this invention and various modifications can be made by those skilled in the art without departing from the scope and spirit of the invention.

What is claimed is:

1. A handheld electronic device comprising:

transceiver circuitry;

a transmission line coupled to the transceiver circuitry; and an antenna that is coupled to the transmission line, wherein the antenna has a ground plane that has dielectric-filled openings defining a first slot and a second slot, wherein the first slot has a main longitudinal axis, wherein the second slot has a main longitudinal axis, wherein the first and second slots are oriented so that the main longitudinal axis of the first slot is oriented at an angle of between 5° and 85° with respect to the main longitudinal axis of the second slot, wherein the ground plane is configured so that the second slot has a straight portion with a longitudinal axis that is oriented parallel to the main longitudinal axis of the first slot, wherein the second slot has a first width in the straight portion, wherein the ground plane is further configured to define an end portion of the second slot that has a longitudinal axis that is angled with respect to the longitudinal axis of the straight portion of the second slot and that has a second width that is larger than the first width in the straight portion, wherein the second width is perpendicular to the longitudinal axis of the end portion of the second slot, and wherein the end portion is substantially rectangular in shape and has a longitudinal axis that is oriented perpendicular to the longitudinal axis of the straight portion.

2. The handheld electronic device defined in claim 1 wherein the antenna has first and second antenna feed terminals, the handheld electronic device further comprising:

a dielectric support structure having first and second conductive vias that are coupled to first and second antenna feed terminals.

3. A dual slot handheld electronic device antenna formed from a ground plane, comprising:

an open slot in the ground plane that has an open end; and a closed slot in the ground plane that has a first portion that is oriented along a main longitudinal axis of the closed slot and that has a first width and that has first and second ends that are enclosed by conductive portions, wherein the second end of the closed slot has a longitudinal axis that is angled with respect to the main longitudinal axis of the closed slot and has a second width that is perpendicular to the longitudinal axis of the second end of the closed slot, wherein the second width is larger than the first width, wherein the first end of the closed slot has a longitudinal axis that is angled with respect to the main longitudinal axis of the closed slot and has a third width that is perpendicular to the longitudinal axis of the first end of the closed slot, and wherein the third width is approximately equal to the first width.

4. The dual slot handheld electronic device antenna defined in claim 3 wherein the open slot has a length of at least 10 mm and operates at 2.4 GHz and wherein the closed slot has a length of at least 10 mm and operates at 5.4 GHz.

5. The dual slot handheld electronic device antenna defined in claim 4 wherein the open slot has no angled portions and wherein the closed slot has at least one portion that is angled away from the open slot.

* * * * *